US009317007B2

(12) United States Patent
Takagi et al.

(10) Patent No.: US 9,317,007 B2
(45) Date of Patent: Apr. 19, 2016

(54) IMAGE FORMING APPARATUS HAVING HOUSING, EXPOSING MEMBER DISPOSED IN THE HOUSING, AND PROCESS CARTRIDGE MOUNTED IN THE HOUSING

(71) Applicant: Brother Kogyo Kabushiki Kaisha, Nagoya-shi, Aichi-ken (JP)

(72) Inventors: Takeyuki Takagi, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,366

(22) Filed: Jan. 9, 2015

(65) Prior Publication Data

US 2015/0160607 A1 Jun. 11, 2015

Related U.S. Application Data

(63) Continuation-in-part of application No. PCT/JP2012/080828, filed on Nov. 29, 2012.

(30) Foreign Application Priority Data

Jul. 9, 2012 (JP) ..... 2012-154136

(51) Int. Cl.
*G03G 21/16* (2006.01)
*G03G 21/18* (2006.01)

(52) U.S. Cl.
CPC ..... *G03G 21/1803* (2013.01); *G03G 21/1853* (2013.01); *G03G 21/1666* (2013.01)

(58) Field of Classification Search
CPC G03G 15/04; G03G 21/1803; G03G 21/1853
USPC ..... 399/111–114, 118
See application file for complete search history.

(56) References Cited

U.S. PATENT DOCUMENTS 5,606,406 A 2/1997 Ikeyama et al.
5,930,561 A 7/1999 Hosokawa et al.
(Continued)

FOREIGN PATENT DOCUMENTS

JP H03-021978 A 1/1991
JP H04-067967 A 3/1992
(Continued)

OTHER PUBLICATIONS

Jan. 22, 2015—International Preliminary Report on Patentability—Intl App PCT/JP2012/080836.
(Continued)

*Primary Examiner* — Hoang Ngo
(74) *Attorney, Agent, or Firm* — Banner & Witcoff, Ltd.

(57) ABSTRACT

An image forming apparatus includes a housing, a cartridge, and an exposing member. The housing is formed with an opening. The cartridge is configured to be detachably mounted in the housing through the opening. The cartridge is provided with an image bearing member, and a holding part configured to be held by a user so as to remove the cartridge from the housing. The exposing member is disposed in the housing and configured to emit a laser light to the image bearing member in an emitting direction so as to expose the image bearing member to the laser light. The cartridge is mounted in the housing at a side opposite to the opening with respect to a trajectory of the laser light.

14 Claims, 7 Drawing Sheets

(56) References Cited

U.S. PATENT DOCUMENTS

| | | | | |
|---|---|---|---|---|
| 6,681,088 | B2 * | 1/2004 | Kanno et al. | 399/111 |
| 7,805,097 | B2 | 9/2010 | Mase et al. | |
| 7,953,339 | B2 | 5/2011 | Fukamachi et al. | |
| 8,571,445 | B2 | 10/2013 | Komatsu et al. | |
| 8,886,081 | B2 | 11/2014 | Yokota | |
| 2007/0274752 | A1 | 11/2007 | Imaizumi | |
| 2008/0181661 | A1 | 7/2008 | Mase et al. | |
| 2008/0199204 | A1 | 8/2008 | Ishii et al. | |
| 2008/0212993 | A1 | 9/2008 | Ishii et al. | |
| 2008/0240774 | A1 | 10/2008 | Fukamachi et al. | |
| 2010/0278559 | A1 | 11/2010 | Komatsu et al. | |
| 2012/0070185 | A1 | 3/2012 | Yokota | |
| 2012/0328324 | A1 | 12/2012 | Chadani et al. | |
| 2014/0112685 | A1 | 4/2014 | Komatsu et al. | |
| 2015/0125178 | A1 | 5/2015 | Sakuma et al. | |

FOREIGN PATENT DOCUMENTS

| | | | |
|---|---|---|---|
| JP | H06-110264 | A | 4/1994 |
| JP | H06-148967 | A | 5/1994 |
| JP | H10-074032 | A | 3/1998 |
| JP | H10-143031 | A | 5/1998 |
| JP | H10-333531 | A | 12/1998 |
| JP | 2001-022250 | A | 1/2001 |
| JP | 2001-242767 | A | 9/2001 |
| JP | 2004-224507 | A | 8/2004 |
| JP | 2005-099380 | A | 4/2005 |
| JP | 2008-185827 | A | 8/2008 |
| JP | 2008-203566 | A | 9/2008 |
| JP | 2008-249802 | A | 10/2008 |
| JP | 2008-276138 | A | 11/2008 |
| JP | 2010-262056 | A | 11/2010 |
| JP | 2011-100006 | A | 5/2011 |
| JP | 2012-068371 | A | 4/2012 |

OTHER PUBLICATIONS

Jan. 22, 2015—International Preliminary Report on Patentability—Intl App PCT/JP2012/080828.

Jun. 25, 2015—(US) Non-Final Office Action—U.S. Appl. No. 14/593,281.

Oct. 16, 2015—(US) Notice of Allowance—U.S. Appl. No. 14/593,281.

Dec. 8, 2015—(JP) Office Action—App 2012-154145.

Dec. 15, 2015—(JP) Office Action—App 2012-154136.

* cited by examiner

IMAGE FORMING APPARATUS HAVING HOUSING, EXPOSING MEMBER DISPOSED IN THE HOUSING, AND PROCESS CARTRIDGE MOUNTED IN THE HOUSING

CROSS REFERENCE TO RELATED APPLICATION

This application claims priority from Japanese Patent Application No. 2012-154136 filed Jul. 9, 2012. This application is also a continuation-in-part of International Application No. PCT/JP2012/080828 filed Nov. 29, 2012 in Japan Patent Office as a Receiving Office. The entire contents of both applications are incorporated herein by reference.

TECHNICAL FIELD

As an electrophotographic image forming apparatus, there is known a printer provided with a main body, a process cartridge detachably attached to the main body and having a photosensitive drum, and an exposure device for exposing the photosensitive drum.

BACKGROUND

For example, in a printer described in Japanese Patent Application Publication No. 2011-100006, an exposure device emits an information light (light image) based on image information toward a photosensitive drum. Further, a process cartridge integrally includes a toner-accommodating chamber for storing toner to be supplied to the photosensitive drum and a removed-toner-accommodating chamber for storing waste toner remaining on the photosensitive drum. In the process cartridge, an exposure opening for allowing passage of the information light therethrough is formed between the toner-accommodating chamber and the removed-toner-accommodating chamber. In a state where the process cartridge is attached to the main body, the removed toner-accommodating chamber is disposed above an emission trajectory of the information light, and the toner-accommodating chamber is disposed below the emission trajectory of the information light.

When the process cartridge is detached from the main body, a user holds a holding part provided in the removed toner-accommodating chamber and detaches the process cartridge from the main body.

SUMMARY

However, in the printer described in Japanese Patent Application Publication No. 2011-100006, it is necessary to provide, inside the main body, a space for the user to hold the holding part and a space through which the information light passes to expose the photosensitive drum. Because these spaces are required, there are limitations to downsize the printer.

In view of the foregoing, it is an object of the present invention to provide an downsized image forming apparatus while ensuring a space for holding the holding part and a space through which the information light passes to expose the photosensitive drum.

In order to attain the above and other objects, the invention provides an image forming apparatus. The image forming apparatus includes a housing, a cartridge, and an exposing member. The housing is formed with an opening. The cartridge is configured to be detachably mounted in the housing through the opening. The cartridge is provided with an image bearing member, and a holding part configured to be held by a user so as to remove the cartridge from the housing. The exposing member is disposed in the housing and configured to emit a laser light to the image bearing member in an emitting direction so as to expose the image bearing member to the laser light. The cartridge is mounted in the housing at a side opposite to the opening with respect to a trajectory of the laser light.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Configuration of Printer

Figure 1:
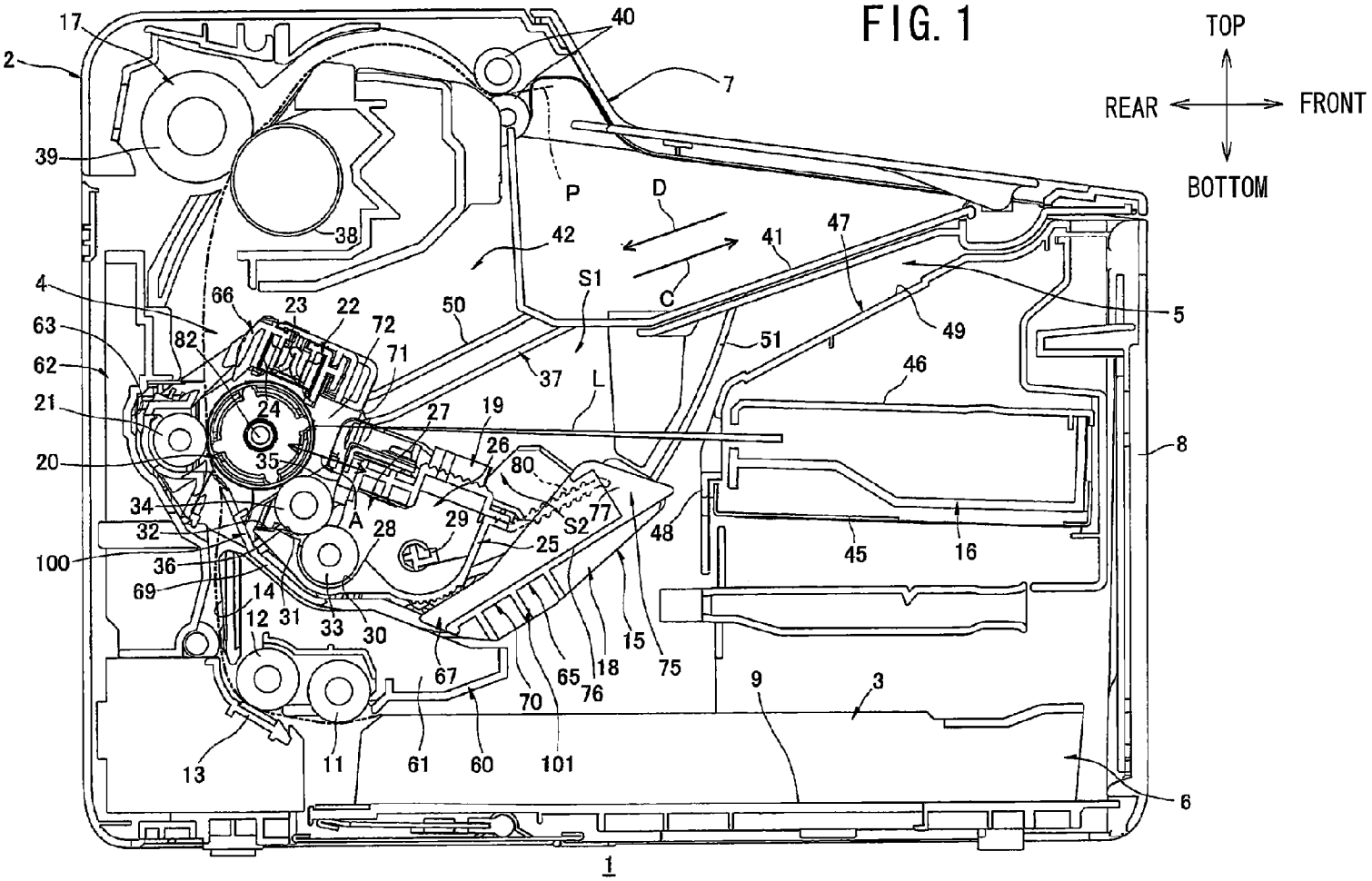
FIG. 1 is a sectional side view of a printer when a top cover is at a covering position according to a first embodiment of the invention.

FIG. 1 shows a printer 1 serving as an example of an image forming apparatus according to an embodiment of the present invention. The printer 1 is provided with a main casing 2 as an example of a housing.

The main casing 2 is box-shaped. The main casing 2 accommodates therein a sheet-feeding unit 3 for feeding sheets P of paper which serve as an example of recording sheet, and an image-forming unit 4 for forming images on the sheets P supplied by the sheet-feeding unit 3.

Directions will be specified based on the state of the printer 1 resting on a level surface. Thus, the right side of FIG. 1 will be considered the front side of the printer 1, and the left side will be considered the rear side of the printer 1. Further, left and right sides of the printer 1 will be defined based on the perspective of a user looking at the printer 1 from the front. Thus, the near side of FIG. 1 is the left side, and the far side is the right side.

Further, a horizontal direction includes a front direction, a rear direction, a left direction, and a right direction. A vertical direction includes an upward direction and a downward direction.

(1) Main Casing

Formed in the main casing 2 are a cartridge access opening 5 (an example of an opening) for mounting and removing a process cartridge 15 (described later), and a paper-introducing opening 6 through which the sheets P of paper are inserted into the main casing 2.

The cartridge access opening 5 is formed in an upper end portion of the main casing 2, penetrating the main casing 2 vertically.

The paper-introducing opening 6 is formed in a bottom portion on a front end portion of the main casing 2 and penetrates the front end portion in a front-rear direction.

The main casing 2 also includes a top cover 7 disposed on the upper end portion thereof, and a sheet-feeding cover 8 disposed on the front end portion thereof. The top cover 7 serves as an example of a cover.

The top cover 7 is formed into a substantially flat plate shape extending in the front-rear direction. A discharge tray 41 (an example of a discharge tray) is formed at a front part of the top cover 7.

The discharge tray 41 corresponds to a recess of the top cover that is concaved downward at a center portion of the top cover 7 in the front-rear direction at its front portion. The discharge tray 41 is formed into a substantially U-shape in a side view opened forward and upward. More specifically, the discharge tray 41 is formed such that a rear end edge thereof extends in the up-down direction and a lower end edge thereof is bent at a lower end portion of the rear end edge to extend forward and is then inclined upward toward the front side.

The top cover 7 is disposed so as to be capable of pivotally moving about its rear edge portion between a closed position for covering the cartridge access opening 5, and an open position (see FIG. 5) for exposing the cartridge access opening 5.

In a state where the top cover 7 is disposed at the closed position, the discharge tray 41 is disposed upper rear side of a scanning unit 16 (more specifically, a second covering part 49 to be described later) so as to face an inside of the main casing 2 through the cartridge access opening 5. That is, in a state where the top cover 7 is disposed at the closed position, the discharge tray 41 is disposed near the scanning unit 16.

The sheet-feeding cover 8 is formed into a substantially flat plate shape extending vertically. The sheet-feeding cover 8 is disposed so as to be capable of pivotally moving about its bottom edge portion between a first position for covering the paper-introducing opening 6, and a second position for exposing the paper-introducing opening 6.

(2) Sheet-Feeding Unit

The sheet-feeding unit 3 includes a sheet-supporting part 9 provided in the bottom portion of the main casing 2.

Figure 2:
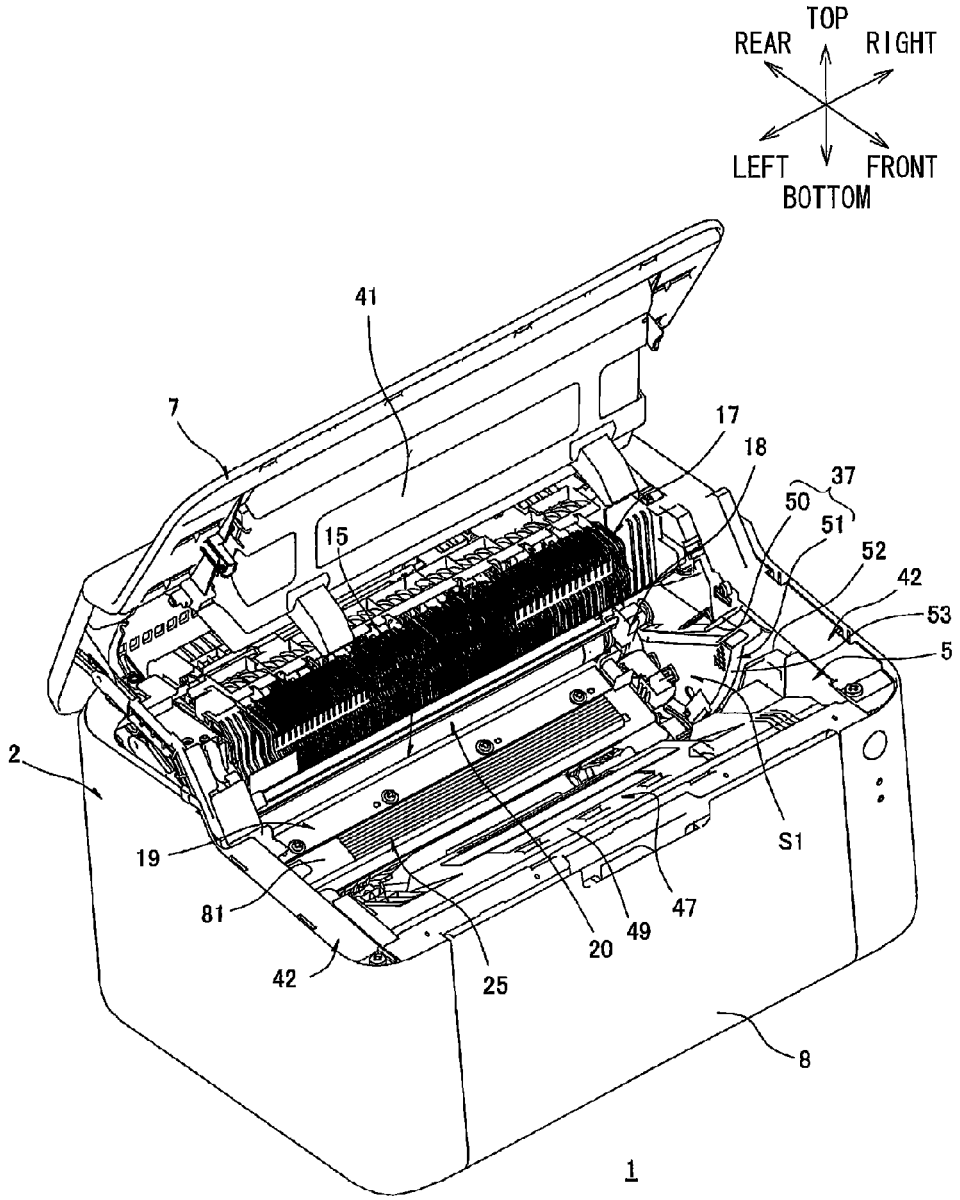
FIG. 2 is a perspective view of the printer of FIG. 1 seeing from upper left.

As shown in FIG. 2, the sheet-supporting part 9 is in communication with the exterior of the main casing 2 through the paper-introducing opening 6.

The sheets P of paper are placed in the sheet-feeding unit 3 when the sheet-feeding cover 8 is in its second position such that rear portions of the sheets P are stacked in the sheet-supporting part 9 and front portions of the sheets P are stacked on a top surface of the sheet-feeding cover 8.

The sheet-feeding unit 3 further includes a pickup roller 11 disposed above a rear edge portion of the sheet-supporting part 9, a feeding roller 12 disposed rearward of the pickup roller 11, a feeding pad 13 arranged to confront the lower rear side of the feeding roller 12, and a feeding path 14 extending continuously upward from a rear edge of the feeding pad 13.

(3) Image-Forming Unit

As shown in FIG. 1, the image-forming unit 4 includes the process cartridge 15 (an example of a cartridge), a scanning unit 16 serving as an exposing member, and a fixing unit 17.

(3-1) Process Cartridge

The process cartridge 15 can be mounted in and removed from the inside of the main casing 2. When mounted in the main casing 2, the process cartridge 15 is arranged above a rear portion of the sheet-feeding unit 3.

The process cartridge 15 includes a drum cartridge 18 and a developing cartridge 19.

The drum cartridge 18 includes a photosensitive drum 20 as an example of an image bearing member, a transfer roller 21, and a scorotron charger 22.

The photosensitive drum 20 is formed in a general cylindrical shape that is elongated in a left-right direction. The photosensitive drum 20 is rotatably provided in a rear portion of the drum cartridge 18.

The transfer roller 21 is formed in a cylindrical shape that is elongated in the left-right direction. The transfer roller 21 is provided in pressure contact with the rear side of the photosensitive drum 20.

More specifically, the transfer roller 21 is disposed on the rear side of the photosensitive drum 20 such that the axial center of the transfer roller 21 is positioned slightly lower than the axial center of the photosensitive drum 20. Note that the transfer roller 21 has a lower peripheral surface higher than a lower peripheral surface of the photosensitive drum 20. That is, a virtual line segment (not shown) connecting the axial center of the transfer roller 21 to the axial center of the photosensitive drum 20 forms an acute angle of approximately 3 degrees with a virtual line (not shown) extending horizontally in the front-rear direction. Accordingly, the weight of the transfer roller 21 does not affect the pressure with which the transfer roller 21 contacts the photosensitive drum 20 (transfer pressure).

The scorotron charger 22 includes a charging wire 23 and a grid 24. The scorotron charger 22 is arranged to confront the upper front side of the photosensitive drum 20 with a gap formed therebetween.

More specifically, the scorotron charger 22 is disposed in a position separated from the transfer roller 21 in a circumferential direction of the photosensitive drum 20. The scorotron charger 22 is disposed such that the virtual line segment (not shown) connecting the axial center of the photosensitive drum 20 with the axial center of the transfer roller 21 forms an angle of approximately 120 degrees with a virtual line segment (not shown) connecting the axial center of the photosensitive drum 20 with a charging wire 23 (described later).

The charging wire 23 is arranged in a taut state to extend in the left-right direction and is disposed so as to confront but remain separated from the upper front side of the photosensitive drum 20.

The grid 24 is formed to have a general U-shape in a side view with the opening of the "U" opening upwardly and forwardly so as to surround the charging wire 23 from a lower rear side thereof.

The developing cartridge 19 is disposed on the lower front side of the photosensitive drum 20. The developing cartridge 19 includes a developing-cartridge frame 25.

A toner-accommodating chamber 26 and a development chamber 27 are formed in the developing-cartridge frame 25. The toner-accommodating chamber 26 and the development chamber 27 are provided side by side in the front-rear direction, with a communication opening 28 allowing communication between the two. The toner-accommodating chamber 26 and the development chamber 27 have substantially the same capacity as each other.

The toner-accommodating chamber 26 accommodates toner (an example of developer). An agitator 29 is provided in an approximate front-rear and vertical center region of the toner-accommodating chamber 26. In other words, the agitator 29 is located at a vertical position lower than the photosensitive drum 20.

In the development chamber 27 are formed a supply-roller groove 30, a developing-roller-opposing surface 31, and a lower-film-adhering surface 32 as part of a top surface of a bottom wall of the development chamber 27.

The supply roller 30 is formed on the top surface of the bottom wall of the development chamber 27 so as to be recessed obliquely downward and rearward. The supply-roller groove 30 is formed in a general semicircular shape conforming to a circumferential surface of a supply roller 33 (described later).

The developing-roller-opposing surface 31 is formed in a general arc shape that conforms to a circumferential surface of a developing roller 34 (described later). The developing-roller-opposing surface 31 extends continuously from a rear edge of the supply-roller groove 30 toward upward and rearward.

The lower-film-adhering surface 32 is formed continuously with a rear edge of the developing-roller-opposing surface 31 and extends rearward therefrom. The lower-film-adhering surface 32 is arranged higher than the developing-roller-opposing surface 31.

The lower-film-adhering surface 32 is also arranged to confront the bottom portion of the photosensitive drum 20 vertically, with a gap formed therebetween. The lower-film-adhering surface 32 is arranged to overlap the axial center of the photosensitive drum 20 when projected or seen vertically.

The supply roller 33, the developing roller 34 (an example of a developer carrying member), a thickness-regulating blade 35, and a lower film 36 are provided in the development chamber 27.

The supply roller 33 is rotatably provided in a front region of the development chamber 27 with its bottom portion disposed in the supply-roller groove 30. With this configuration, the supply roller 33 is disposed at the rear side of the toner-accommodating chamber 26 and is arranged at the same approximate height as the toner-accommodating chamber 26 (slightly higher than the toner-accommodating chamber 26).

The developing roller 34 is rotatably provided in a rear region of the development chamber 27 such that its bottom circumferential surface opposes the developing-roller-opposing surface 31 yet remains separated therefrom.

The developing roller 34 is also disposed to contact the upper rear side of the supply roller 33 and so that its upper and rear portions are exposed outside the development chamber 27 and contact the lower front side of the photosensitive drum 20. In other words, the developing roller 34 is arranged on the upper rear side of the supply roller 33 and the lower front side of the photosensitive drum 20. The axial centers of the supply roller 33, the developing roller 34, and the photosensitive drum 20 are positioned on substantially the same line following a radial direction of the photosensitive drum 20.

The developing roller 34 is also disposed in a position separated from the scorotron charger 22 in the circumferential direction of the photosensitive drum 20 and is arranged such that a virtual line segment (not shown) connecting the axial center of the photosensitive drum 20 to the charging wire 23 forms an angle of approximately 120 degrees with a virtual line segment (not shown) connecting the axial center of the photosensitive drum 20 to the axial center of the developing roller 34. The developing roller 34, the scorotron charger 22, and the transfer roller 21 are arranged at substantially equal intervals in the circumferential direction of the photosensitive drum 20.

The thickness-regulating blade 35 has an upper end fixed to a rear end of a top wall defining the development chamber 27. The thickness-regulating blade 35 has a bottom end that contacts the developing roller 34 from the front side thereof.

The lower film 36 has a rear portion fixed to the lower-film-adhering surface 32. A front edge of the lower film 36 contacts the circumferential surface of the developing roller 34 above the developing-roller-opposing surface 31.

(3-2) Scanning Unit

The scanning unit 16 is arranged in the front region in the main casing 2 at a front side of the process cartridge 15 and confronting the process cartridge 15 in the front-rear direction.

The scanning unit 16 irradiates a laser beam L (an example of a laser light) toward the photosensitive drum 20 based on image data, thereby exposing the circumferential surface of the photosensitive drum 20.

More specifically, the scanning unit 16 irradiates the laser beam L rearward, to thereby expose the circumferential surface of the photosensitive drum 20 on the front side thereof. The irradiating direction of the laser beam L is a direction from front side to rear side. That is, the front-rear direction includes the irradiating direction.

In other words, the exposure point at which the photosensitive drum 20 is exposed to light (the circumferential surface on the front side of the photosensitive drum 20) is configured to be on a side opposite to a nip part at which the photosensitive drum 20 and the transfer roller 21 contact each other with respect to the axial center of the photosensitive drum 20.

At this time, the developing cartridge 19 is arranged beneath an irradiation path of the laser beam L, while the scorotron charger 22 is disposed above the irradiation path of the laser beam L.

(3-3) Fixing Unit

The fixing unit 17 is disposed above the rear portion of the drum cartridge 18. More specifically, the fixing unit 17 includes a heating roller 38 disposed above the scorotron charger 22, and a pressure roller 39 that contacts the heating roller 38 on an upper rear side thereof with pressure.

Hence, the heating roller 38 is disposed near an upper edge (open side edge) of the grid 24 in the scorotron charger 22.

(4) Image-Forming Operation

The agitator 29 rotates to supply toner from the toner-accommodating chamber 26 of the developing cartridge 19 to the supply roller 33 through the communication opening 28. The supply roller 33 in turn supplies the toner onto the developing roller 34. The toner is positively tribocharged between the supply roller 33 and the developing roller 34.

The thickness-regulating blade 35 regulates the thickness of toner supplied to the developing roller 34 as the developing roller 34 rotates so that a thin layer of toner of uniform thickness is carried on the surface of the developing roller 34.

In the meantime, the scorotron charger 22 uniformly charges the surface of the photosensitive drum 20. The scanning unit 16 subsequently exposes the surface of the photosensitive drum 20, forming an electrostatic latent image on the circumferential surface of the photosensitive drum 20 based on image data. Next, the toner carried on the developing roller 34 is supplied to the latent image on the circumferential surface of the photosensitive drum 20 so that a toner image (developer image) is carried on the circumferential surface of the photosensitive drum 20.

The rotating pickup roller 11 supplies the sheets P stacked on the sheet-supporting part 9 between the feeding roller 12 and the feeding pad 13, and the rotating feeding roller 12 separates the sheets P, conveys each separated sheet P onto the feeding path 14, and supplies the sheets P one at a time to the image-forming unit 4 (between the photosensitive drum 20 (to be described later) and the transfer roller 21 (to be described later)) at a prescribed timing.

The sheet P is conveyed upward between the photosensitive drum 20 and the transfer roller 21, at which time the toner image is transferred from the photosensitive drum 20 onto the sheet P, forming an image on the sheet P.

Next, the sheet P passes between the heating roller 38 and the pressure roller 39. At this time, the heating roller 38 and the pressure roller 39 apply heat and pressure to the sheet P to thermally fix the image to the sheet P.

The sheet P is subsequently conveyed toward discharge rollers 40. The discharge rollers 40 discharge the sheet P onto the discharge tray 41 formed on a top surface of the main casing 2.

In this way, the sheet P is supplied from the sheet-supporting part 9 and conveyed along a conveying path that has a general C-shape in a side view, passing first between the photosensitive drum 20 and the transfer roller 21 (nip part) and next between the heating roller 38 and the pressure roller 39, and subsequently being discharged onto the discharge tray 41.

2. Details of Main Casing (1) Process Cartridge Mounting Part

As illustrated in FIG. 1, a process cartridge mounting part 60 is provided in the main casing 2.

The process cartridge mounting part 60 is configured to support the process cartridge 15 disposed at a mounted position (to be described later). The process cartridge mounting part 60 is disposed at a rear end part of the internal space of the main casing 2 and disposed between a rear portion of the sheet-feeding unit 3 and the fixing unit 17 in the vertical direction.

The process cartridge mounting part 60 is formed into a substantially L-shape in a side view and extends in the left-right direction. The process cartridge mounting part 60 includes a first mounting part 61 and a second mounting part 62.

The first mounting part 61 is formed into a substantially rectangular shape in a side view extending in the front-rear direction. The first mounting part 61 rotatably supports the pickup roller 11 and the feeding roller 12 at its lower end portion. The top surface of the first mounting part 61 is formed conforming to a lower end portion of the process cartridge 15 (specifically, a bottom wall 69 (to be described later) of a cartridge mounting part 67 (to be described later)).

The second mounting part 62 is formed into a substantially rectangular shape in a side view extending in the vertical direction. An engagement groove 63 is formed on the front surface of the second mounting part 62 at its substantially center region in the vertical direction.

The engagement groove 63 is formed on the front surface of the second mounting part 62 so as to be recessed rearward. The engagement groove 63 is formed in a substantially curved shape in a side view conforming to the rear end portion of the process cartridge 15 (specifically, a rear end portion of a drum accommodating part 66 (to be described later)).

The second mounting part 62 is disposed rearward of the first mounting part 61 such that part of the front surface of the second mounting part 62 below the engagement groove 63 confronts the rear surface of the first mounting part 61 with a space formed therebetween in the front-rear direction. The rear surface of the first mounting part 61 and the part of the front surface of the second mounting part 62 below the engagement groove 63 constitute the above-described feeding path 14.

(2) Scanning Unit

The scanning unit 16 is disposed rearward and upward of the paper-introducing opening 6. The scanning unit 16 is disposed forward of the second mounting part 62 such that the scanning unit 16 confronts the second mounting part 62 with a space formed therebetween in the front-rear direction. The scanning unit 16 is disposed forward of the photosensitive drum 20 with a space therebetween.

The scanning unit 16 includes a scanner support part 45, a scanner main body 46, and a scanner cover 47.

The scanner support part 45 is formed into a substantially U-shape in a side view, with the opening of the "U" shape opening upward, and extends in the left-right direction. The scanner support part 45 is fixed to the main casing 2 with its left and right edges supported by the left and right side walls of the main casing 2, respectively, and with its front edge supported by part of the main casing 2 at a periphery of an upper edge of the paper-introducing opening 6.

The scanner main body 46 is formed into a box shape having a substantially rectangular shape in a side view. A laser emitting part (not illustrated) and a polygon mirror (not illustrated) are accommodated in the internal space of the scanner main body 46. The scanner main body 46 is supported on a top surface of the scanner support part 45.

The scanner cover 47 is formed into a substantially V shape in a side view, with the opening of the "V" shape opening toward obliquely forward and downward. The scanner cover 47 integrally includes a first cover part 48 and a second cover part 49.

The first cover part 48 is formed into a substantially flat plate shape extending in the vertical and left-right directions.

The second cover part 49 is formed into a substantially flat plate shape extending continuously from an upper edge of the first cover part 48 toward forward and upward in a removing direction C (to be described later) of the process cartridge 15, in which the process cartridge 15 is mounted in or removed from the main casing 2.

The scanner cover 47 is disposed such that the first cover part 48 covers the scanner main body 46 from the rear side and the second cover part 49 covers the scanner main body 46 from the upper side. The scanner cover 47 is supported by the main casing 2 such that the upper edge of the second cover part 49 is fixed to the upper end portion of the front end portion of the main casing 2.

A process cartridge mounting/removing space S1 (an example of an mounting/removing space in a housing) is provided for mounting/removing the process cartridge 15 to/from the main casing 2. The process cartridge mounting/removing space S1 is disposed rearward of the scanning unit 16. Specifically, the process cartridge mounting/removing space S1 is provided between the second mounting part 62 and the scanning unit 16 in the front-rear direction (see FIG. 5).

(3) Guide Part

A guide part 37 is provided on inner surfaces of the main casing 2 (inner surfaces of the left and right side walls 42 (FIG. 2) of the main casing 2) corresponding to the mounting/removing space S1.

The guide parts 37 are formed in a pair of left and right side walls 42 (see FIG. 2) of the main casing 2 facing each other. The guide parts 37 are recessed outward in the left-right direction from the inner surfaces of the side walls 42.

In the present embodiment, the guide parts 37 formed in the pair of left and right side walls 42 have the same configuration. Thus, hereinafter, the guide part 37 formed in the right side wall 42 will be described in detail, and description of the guide part 37 formed in the left side wall 42 will be omitted.

Figure 7:
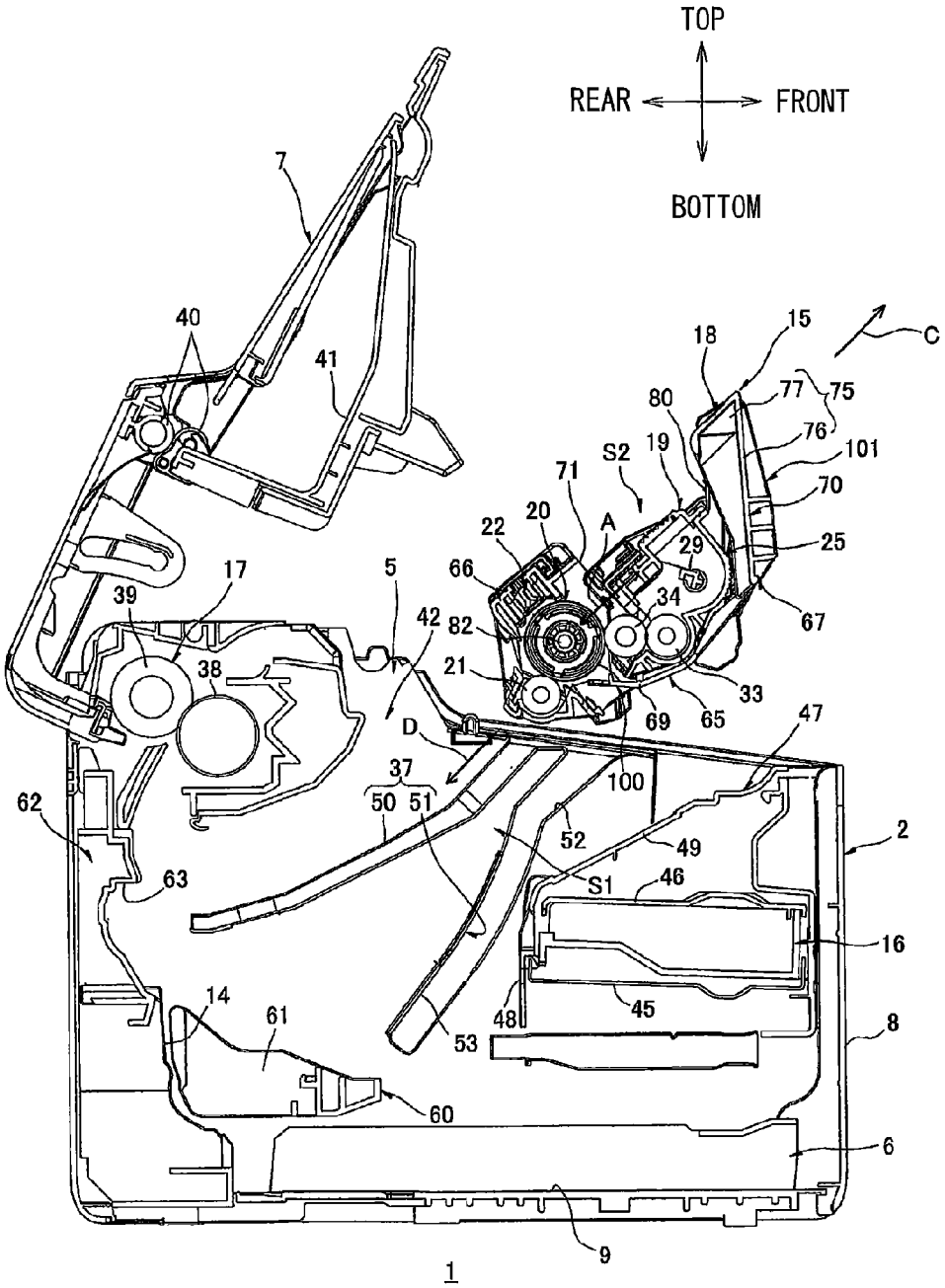
FIG. 7 is a sectional side view of the printer illustrating the mounting or removing operation where the process cartridge is at a removed position according to the first embodiment.

As illustrated in FIG. 7, the guide part 37 includes a drum shaft guide part 50 as an example of a first guide part and a boss guide part 51 as an example of a second guide part.

The drum shaft guide part 50 is a groove formed in the inner surface of the side wall 42. The drum shaft guide part 50 is formed in an inner surface of the side wall 42 with respect to the left-right direction (that is, the inner surface whose normal direction is substantially parallel to the left-right direction). The drum shaft guide part 50 is formed from a substantially center portion of an upper end portion (cartridge access opening 5) of the side wall 42 in the front-rear direction. The drum shaft guide part 50 is inclined downward toward rearward from the substantially center portion of the upper end portion of the side wall 42. A rear end portion of the drum shaft guide part 50 is disposed at a substantially center portion of a rear end portion of the side wall 42 in the vertical direction The rear end portion of the drum shaft guide part 50 is disposed at front side of the engagement groove 63 of the second mounting part 62 with a space therebetween. The groove width of the drum shaft guide part 50 is substantially equal to (slightly longer than) an outer diameter of the drum shaft 82.

The boss guide part 51 is a groove formed in the inner surface of the side wall 42. The boss guide part 51 is disposed at front side of the drum shaft guide part 50 with a gap therebetween. The boss guide part 51 is inclined rearward toward downward from an upper end portion of the side wall 42 (cartridge access opening 5).

More specifically, the boss guide part 51 integrally includes an upper-side first portion 52 and a lower-side second portion 53.

The first portion 52 is provided upper rear side of the second covering part 49 of the scanner cover 47 with a space therebetween in a side view. Further, the first portion 52 is inclined downward toward rearward from the upper end portion (cartridge access opening 5) of the side wall 42 at substantially the same inclination direction of the drum shaft guide part 50.

In a side view, the second end portion 53 extends continuously from a lower end portion of the first portion 52. That is, the second portion 53 is connected to the lower end portion of the first portion 52. The connecting portion between the second portion 53 and the first portion 52 is disposed above the connecting portion between the first and second covering parts 48 and 49. Further, the second portion 53 is inclined rearward toward downward. More specifically, the second portion 53 is bent at the connection portion to the first portion 52 such that a slope of the second portion 53 is more steeper than a slope of the first portion 52. The second portion 53 passes through a region rear side of the first covering part 48. That is, the drum shaft guide part 50 and the boss guide part 51 (second portion 53) are provided such that an interval therebetween in the front-rear direction increases toward the rear-lower side (downstream side of a mounting direction D (to be described later)).

Further, the second portion 53 is formed into a substantially curved shape bulging forward and downward in a side view.

Further, a rear end portion of the second portion 53 is disposed front and down side of the rear end portion of the drum shaft guide part 50. The rear end portion of the second portion 53 is disposed front side of a front end portion of the first mounting part 61 with a space therebetween.

Groove widths between the first and second parts 52 and 53 are substantially equal to (slightly longer than) an outer diameter of the guide boss 73.

3. Details of Process Cartridge

Figure 3:
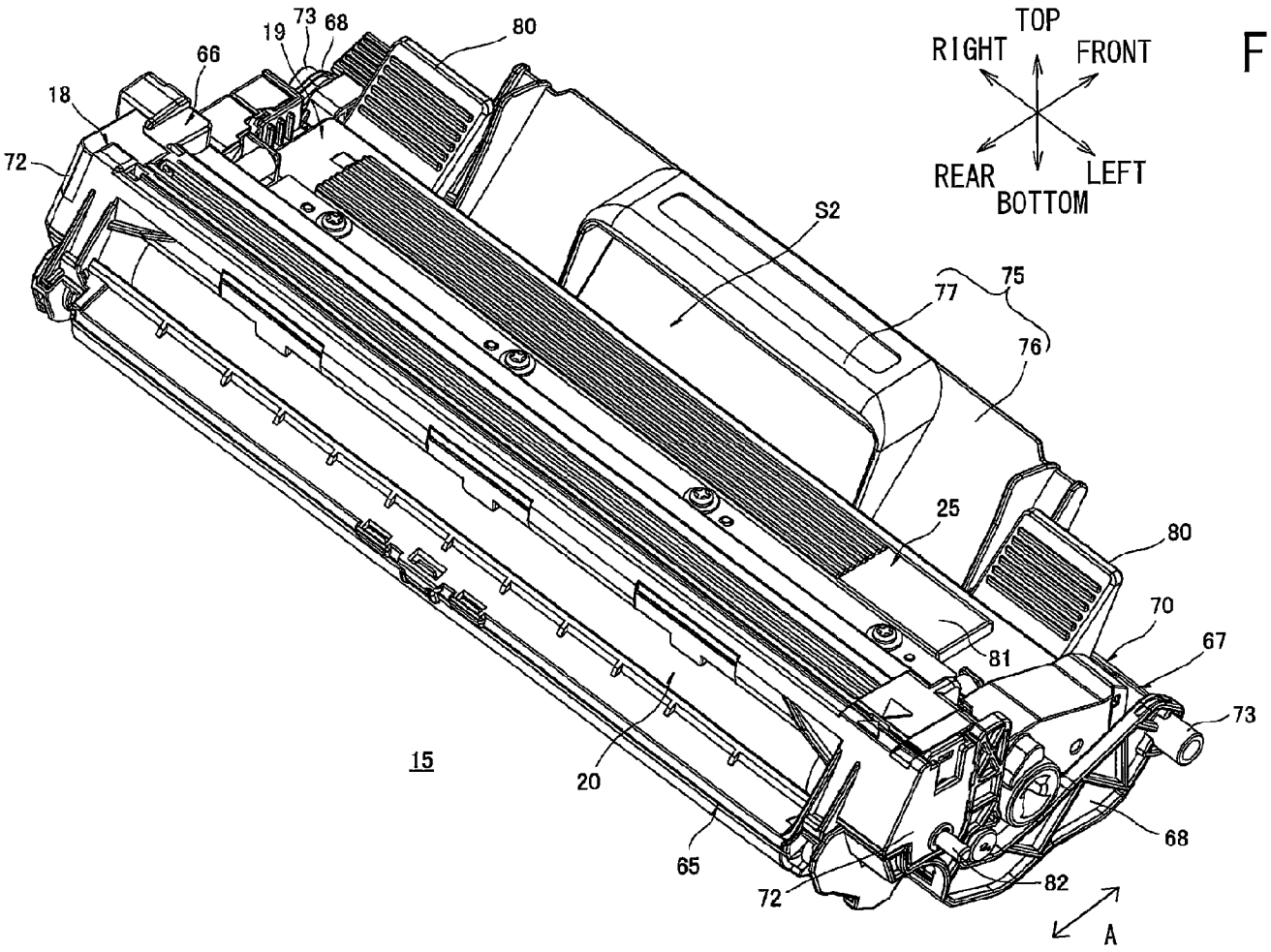
FIG. 3 is a perspective view of a process cartridge seeing from upper left according to the first embodiment.

As shown in FIG. 3, the process cartridge 15 includes the drum cartridge 18 and the developing cartridge 19. The drum cartridge 18 is removably mountable in the main casing 2 as shown in FIG. 1. The developing cartridge 19 is detachably attached to the drum cartridge 18.

The up-down and front-rear directions of the process cartridge 15 in a state attached to the main casing 2 as shown in FIG. 1 are slightly different from the up-down and front-rear directions thereof in a state placed horizontally as shown in FIG. 3. As illustrated in FIG. 1, in a state where the process cartridge 15 is attached to the main casing 2, a front side thereof in FIG. 3 is disposed at the front-lower side of the printer 1 and a rear side thereof in FIG. 3 is disposed at the rear-upper side of the printer 1.

Hereinafter, when referring to the direction of the process cartridge 15, a state (FIG. 1, FIG. 2, and FIGS. 5 to 7) where the process cartridge 15 is attached to the main casing 2 is basically used as a reference. However, some explanations are made by using directions of arrows shown in FIGS. 3 and 4 as needed.

(1) Drum Cartridge

Figure 4:
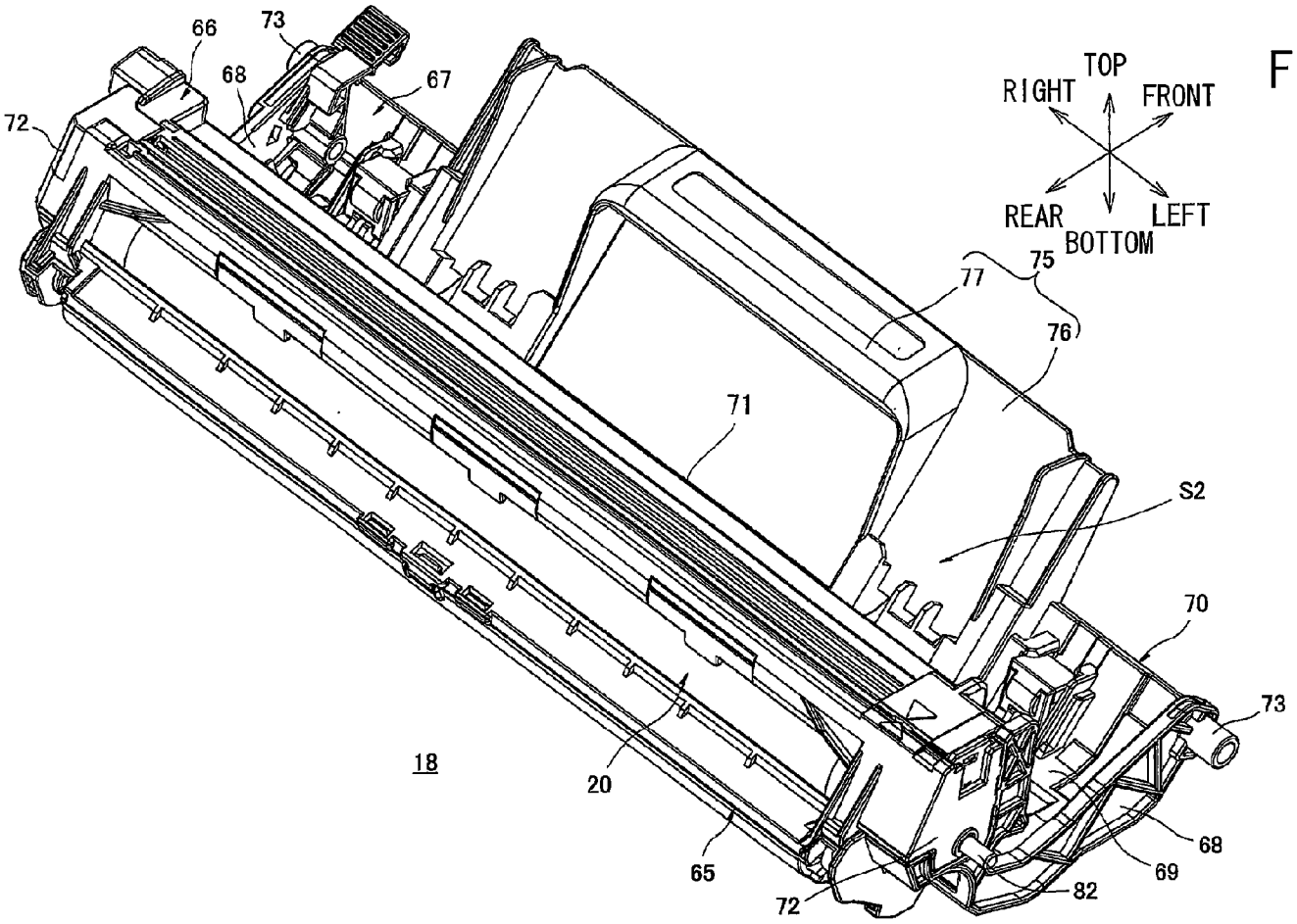
FIG. 4 is a perspective view of a drum cartridge seeing from upper left according to the first embodiment.

As shown in FIG. 4, the drum cartridge 18 has a drum frame 65 as an example of an image-bearing-member frame.

A rear portion of the drum frame 65 is formed as the drum accommodating part 66 (an example of an image-bearing-member accommodating part), and a front portion of the drum frame 65 is formed as a cartridge mounting part 67 (an example of a developer-cartridge accommodating part).

More in detail, as illustrated in FIG. 1, in a state where the process cartridge 15 is disposed at the mounted position, the drum accommodating part 66 is disposed rearward and upward of the cartridge mounting part 67 so as to be juxtaposed and adjacent to the cartridge mounting part 67 in an adjacent direction A. The adjacent direction A is a direction parallel to a line connecting the cartridge mounting part 67 and the drum accommodating part 66 (or photosensitive drum 20) and is directed from the front-lower side to rear-upper side in FIG. 1 or from the rear-upper side to front-lower side.

When a process cartridge 15 is placed horizontally as shown in FIG. 3, the adjacent direction A is substantially the same as the front-rear direction.

(1-1) Drum Accommodating Part

As shown in FIG. 4, the drum accommodating part 66 is formed into a substantially box shape extending in the left-right direction and having its front side opened. A front end portion of the drum accommodating part 66 defines a drum opening 71 as shown in FIG. 1. The drum accommodating part 66 includes a pair of drum-accommodating-part side walls 72 which are disposed opposite to each other with a space formed therebetween in the left-right direction.

Each drum-accommodating-part side wall 72 is formed into a substantially flat plate shape having a substantially rectangular shape in a side view and extending in the vertical and front-rear directions.

As illustrated in FIG. 1, the photosensitive drum 20 and the transfer roller 21 are accommodated in the drum accommodating part 66.

As shown in FIG. 4, the photosensitive drum 20 has a drum shaft 82 extending in the left-right direction. The photosensitive drum 20 is rotatably supported in the drum accommodating part 66, with left and right ends of the drum shaft 82 being supported by the pair of drum-accommodating-part side walls 72. Note that the left and right ends of the drum shaft 82 penetrate the drum-accommodating-part side walls 72 and protrude outward in the left-right direction.

(1-2) Cartridge Mounting Part

The cartridge mounting part 67 is formed into a substantially box shape with its upper side opened to allow the developing cartridge 19, shown in FIG. 3, to be attached to and detached from the cartridge mounting part 67. The cartridge mounting part 67 includes: a pair of cartridge-mounting-part side walls 68 disposed opposite to each other with a space formed therebetween in the left-right direction; a bottom wall 69 connecting the lower edges of the cartridge-mounting-part side walls 68; and a front wall 70 connecting the front edges of the cartridge-mounting-part side walls 68. The cartridge mounting part 67 is in communication with the drum accommodating part 66 through the drum opening 71 in the adjacent direction A.

The cartridge mounting part 67 includes: a pair of cartridge-mounting-part side walls 68 disposed opposite to each other with a space formed therebetween in the left-right direction; a bottom wall 69 connecting the lower edges of the cartridge-mounting-part side walls 68; and a front wall 70 connecting the front edges of the cartridge-mounting-part side walls 68.

Each cartridge-mounting-part side wall 68 is formed into a substantially flat plate shape extending continuously forward from the lower end portion on the front edge of the corresponding drum-accommodating-part side wall 72.

A guide boss 73 is integrally provided outer surfaces of the cartridge-mounting-part side walls 68 with respect to the left-right direction.

The guide boss 73 is formed into a substantially cylindrical shape disposed at the outer surface of the cartridge-mounting-part side wall 68 with respect to the left-right direction. The guide boss 74 protrudes outwardly in the left-right direction from a front end portion of the cartridge-mounting-part side wall 68.

The bottom wall 69 is formed into a substantially flat plate shape extending in the front-rear direction and the left-right direction and is disposed below the developing cartridge 19 attached to the cartridge mounting part 67 (see FIG. 1). That is, the bottom wall 69 is provided at a side opposite to the emission trajectory of the laser beam L with respect to the developing cartridge 19.

The front wall 70 is formed so as to be inclined forward (see FIG. 1) toward the upper side from its lower end portion (base end portion). Here, the lower end portion of the front wall 70 extends continuously from a front end portion of the bottom wall 69. The front wall 70 is disposed front side of the developing cartridge 19 attached to the cartridge mounting part 67. That is, the front wall 70 is provided at a side opposite to the drum accommodating part 66 with respect to the developing cartridge 19.

Further, as illustrated in FIG. 4, a holding part 75 is provided in the cartridge mounting part 67.

The holding part 75 is provided integrally with the front wall 70 and includes a main body 76 (an example of a second wall part) and a holding portion 77 (an example of a holding portion).

As shown in FIG. 1, the main body 76 is formed so as to be inclined forward toward the upper side from a base end portion thereof. This base end portion of the main body 76 extends continuously from a substantially center portion of an upper end portion of the front wall 70 in the left-right direction. Specifically, the main body 76 is inclined toward a direction substantially equal to the inclination direction of the front wall 70. Further, the main body 76 is formed into a substantially flat plate shape extending in the left-right direction and is disposed at a side opposite to the drum accommodating part 66 with respect to the developing cartridge 19 attached to the cartridge mounting part 67.

That is, the main body 76 is inclined so as to be separated away from the developing cartridge 19 toward the upper side, that is, toward the emission trajectory of the laser beam L, from the base end portion (lower end portion) thereof. Here, the base end portion of the main body 76 extends continuously from the upper end portion of the front wall 70. In other words, the front wall 70 has a base end portion and another end portion. The front wall 70 extends such that another end portion of the front wall 70 is farther apart from the developing cartridge 19 than the base end portion of the front wall 70 from the developing cartridge 19.

Figure 5:
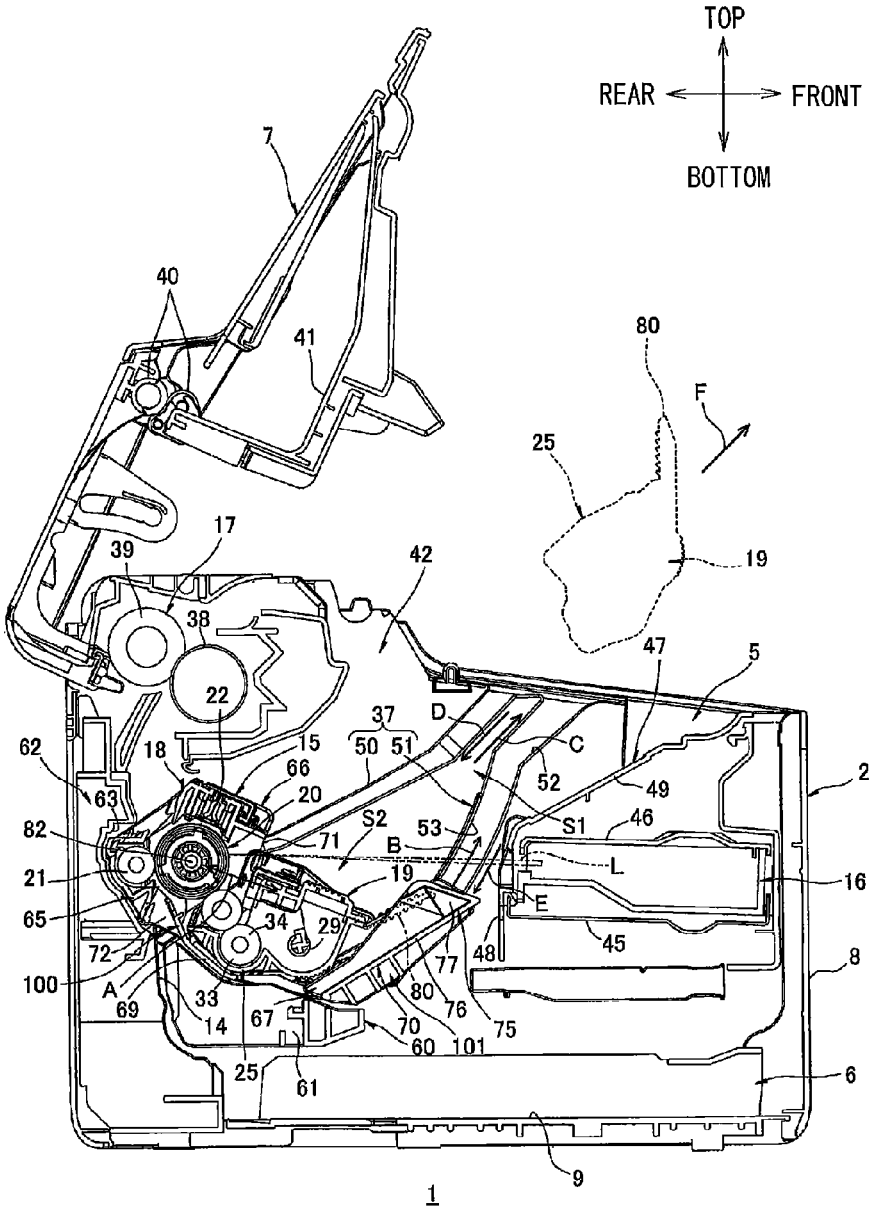
FIG. 5 is a sectional side view of the printer illustrating a mounting or removing operation to mount or remove the process cartridge to or from a main casing where the process cartridge is disposed at a mounted position when the top cover is opened according to the first embodiment.

As illustrated in FIG. 4, the holding portion 77 is provided at a substantially center portion of a rear surface of the main part 76 in the left-right direction. The holding portion 77 is formed into a substantially triangular shape in a side view protruding rearward and upward from the upper end portion of the rear surface of the main part 76. That is, the holding portion 77 is provided at a free end portion (upper end portion) of the main part 76 which is disposed at a side opposite to the base end portion (lower end portion) of the main part 76. In other words, the holding part 77 is provided at a side opposite to the photosensitive drum 20 with respect to the developing cartridge 19 in the adjacent direction A. As illustrated in FIG. 5, in a state where the process cartridge 15 is disposed at the mounted position, a front end portion (holding part 75 side) of the process cartridge 15 is disposed down side of a rear end portion (photosensitive drum 20 side) of the process cartridge 15.

Further, as illustrated in FIG. 3, a developing cartridge removing space S2 (an example of a removing space and an inside-frame removing space) is provided in the drum frame 65. The developing cartridge removing space S2 located above the developing cartridge 19 attached to the cartridge mounting part 67 and between the drum accommodating part 66 and the main part 76 in the adjacent direction A.

The holding portion 77 provided in the main part 76 is disposed inside the cartridge mounting part 67 so as to provide the developing cartridge removing space S2. That is, the holding portion 77 is adjacent to the developing cartridge removing space S2. In other words, the holding part 75 (the main part 76 and the holding portion 77) defines a part of the developing cartridge removing space S2.

(2) Developing Cartridge

As illustrated in FIG. 3, the developing cartridge 19 includes the developing cartridge frame 25.

The developing-cartridge frame 25 is formed into a substantially box shape extending in the left-right direction as shown in FIG. 1. The developing-cartridge frame 25 is provided with two developing-cartridge holding parts 80 at its front edge and an information display part 81 at its top end.

The developing-cartridge holding parts 80 are provided to the front edge of the developing-cartridge frame 25 at left and right end portions thereof. Each developing-cartridge holding part 80 is formed into a substantially flat plate shape extending continuously from the front edge of the developing-cartridge frame 25 toward forward and upward as shown in FIG. 1, and extending also in the left-right direction.

The information display part 81 is provided at a left side portion of an upper surface of the developing-cartridge frame 25. The information display part 81 displays information concerning the developing cartridge 19 (e.g., type number of stored toner).

As illustrated in FIG. 3, the developing cartridge 19 is detachably attached to the cartridge mounting part 67 of the drum cartridge 18. That is, as illustrated in FIG. 1, the developing cartridge 19 is disposed adjacent to and at lower front side of the photosensitive drum 20. In other words, the developer frame 19 and the photosensitive drum 20 are disposed side by side in the adjacent direction A.

The developing roller 34 of the developing cartridge 19 is disposed inside the drum accommodating part 66 through the drum opening 71 and is brought into contact with the photosensitive drum 20 from the front lower side in FIG. 1.

In a state where the developing cartridge 19 is attached to the cartridge mounting part 67, the plurality of (two) developing cartridge holding parts 80 are arranged side by side in the left-right direction so as to sandwich the holding part 75.

When the developing cartridge 19 is detached from the cartridge mounting part 67, a user holds the developing-cartridge holding parts 80 and pulls the same upwardly and forwardly so as to move a front end part of the developing cartridge 19 upwardly and forwardly.

(3) Mounting State of Process Cartridge in Main Casing

As illustrated in FIG. 1, the process cartridge 15 having the above-described configuration is disposed at the mounted position at which the process cartridge 15 is supported by the process cartridge mounting part 60.

Specifically, when the process cartridge 15 is disposed at the mounted position, the rear end portion of the drum accommodating part 66 is fitted into the engagement groove 63, and the bottom wall 69 of the cartridge mounting part 67 is disposed above the first mounting part 61. Each of the both ends of the drum shaft 82 in the left-right direction is fitted to the rear end of the corresponding drum shaft guide 50. Each guide boss 73 is fitted to the rear end of the second portion 53 of the corresponding boss guide part 51.

The photosensitive drum 20 is disposed rearward of the scanner main body 46 and confronts the scanner main body 46 with a space formed therebetween. The cartridge mounting part 67 is disposed at front side of the drum accommodating part 66 and below the emission trajectory of the laser beam L. That is, the cartridge mounting part 67 is disposed at a side opposite to the cartridge access opening 5 with respect to the emission trajectory of the laser beam L.

More in detail, the cartridge mounting part 67 is inclined downward toward a front end portion 101 (an example of a second end portion) from a rear end portion 100 (an example of a first end portion) in the adjacent direction A so as to be further apart from the emission trajectory of the laser beam L. The rear end portion 100 is connected to the drum accommodating part 66 in the adjacent direction A Accordingly, the holding part 75 is disposed rearward and downward of the scanner body 46 and is spaced apart downward from the emission trajectory of the laser beam L.

In the image forming operation, the laser beam L first passes through the process cartridge mounting/removing space 51 above the holding part 75 from the front side to rear side. Subsequently, the laser beam L passes through the developing cartridge removing space S2 above the developing cartridge 19 from the front side to rear side, and exposes a peripheral surface of the photosensitive drum 20. The peripheral surface of the photosensitive drum 20 is exposed through the drum opening 71 by the laser beam L.

4. Mounting/Removing Operation of Process Cartridge in/from Main Casing

The following describes how to mount the process cartridge 15 in the main casing 2 and how to remove the process cartridge 15 from the main casing 2.

(1) Removing Operation of Process Cartridge from Main Casing

To remove the process cartridge 15 from the main casing 2, first the top cover 7 of the main casing 2 is disposed at its open position as shown in FIG. 5.

At this time, as illustrated in FIG. 2, the information display part 81 of the developing cartridge 19 is exposed through the cartridge access opening 5. That is, when being projected in the removing direction C (see FIG. 5) of the process cartridge 15 to a plane defined by the cartridge access opening 5, the information display part 81 is disposed so as to overlap the cartridge access opening 5. As illustrated in FIG. 5, the removing direction C is directed from the rear lower side to front upper side.

Then, as illustrated in FIG. 5, a user inserts his or her hand into the process cartridge mounting/removing space 51 such that the hand passes through the emission trajectory of the laser beam L from above to below and holds the holding portion 77 of the drum cartridge 18. Then, the user pulls up the holding part 75 until the guide bosses 73 (see FIG. 3) reach an upper end portions of the second portions 53 of the corresponding boss guide parts 51.

Then, the guide bosses 73 (see FIG. 3) are guided by the corresponding second portions 53, whereby the process cartridge 15 is pivotally moved about the drum shaft 82 in a pivotally-moving direction B (counterclockwise direction in a left side view) indicated by an arrow.

Figure 6:
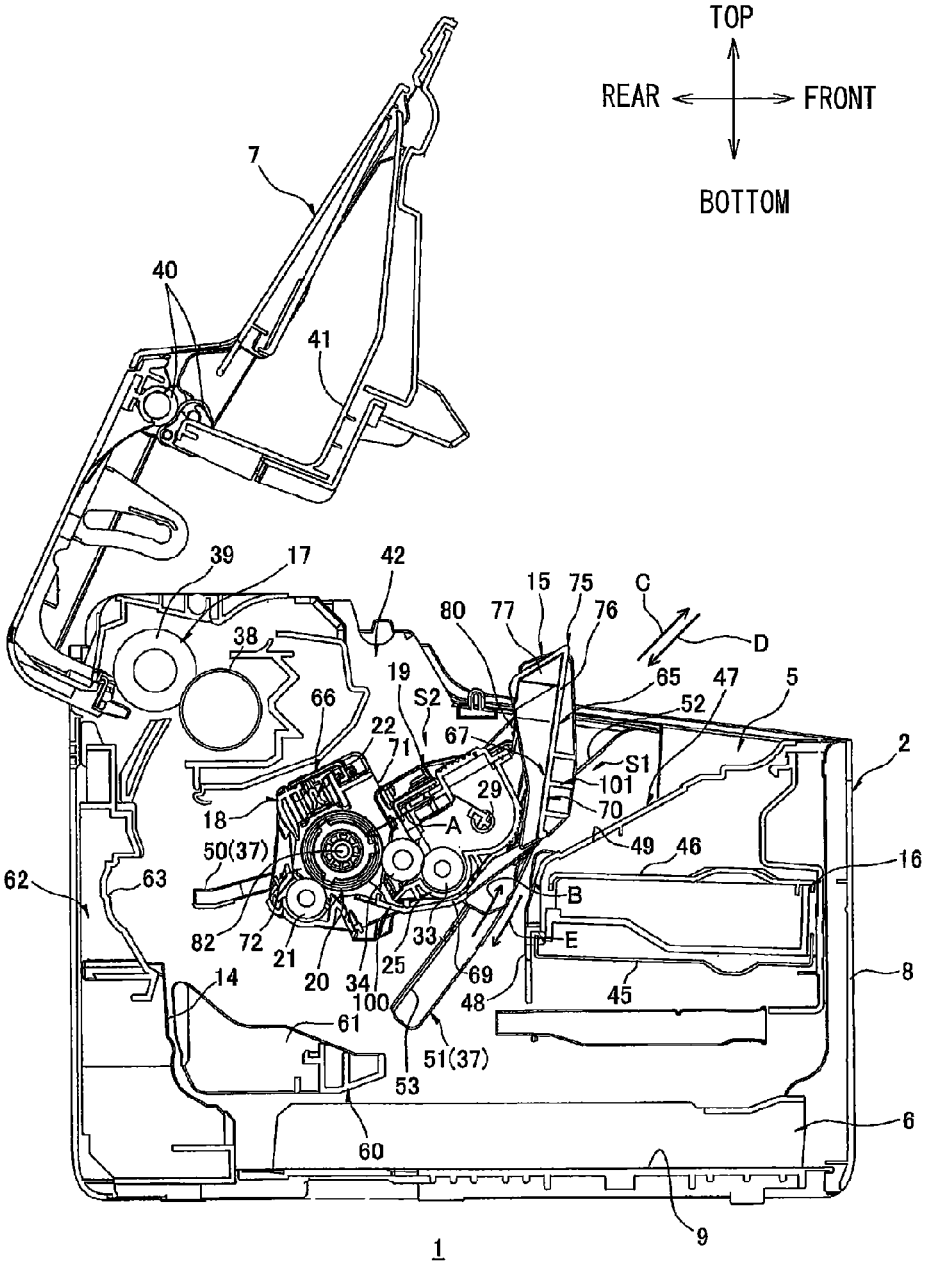
FIG. 6 is a sectional side view of the printer illustrating the mounting or removing operation where the mounting or removing the process cartridge is in midstream according to the first embodiment.

As a result, the front end portion (holding part 75 side) of the process cartridge 15 is moved forward and upward, and the main part 76 of the holding part 75 and the front wall 70 of the cartridge mounting part 67 sequentially pass through a rear side of the first covering part 48 of the scanner cover 47 (see FIG. 6).

On the other hand, as illustrated in FIG. 6, the end portions of the drum shaft 82 in the left-right direction are guided by the corresponding drum shaft guide parts 50 in connection with the pivotal movement (or rotation) of the process cartridge 15 described above, and a rear end portion of the process cartridge 15 is moved forward and upward.

In this state, the developing cartridge 19 attached to the drum cartridge 18 passes through the emission trajectory (see FIG. 5) of the laser beam L from below to above.

Further, the various rollers (the transfer roller 21, the supply roller 33, and the developing roller 34) provided in the process cartridge 15 also pass through the emission trajectory of the laser beam L from below to above.

Then, when the guide bosses 73 (see FIG. 3) reach the upper end portion (see FIG. 5) of the second portions 53, the process cartridge 15 is disposed such that the adjacent direction A is substantially parallel to the removing direction C (directions A and C substantially coincide with each other or are opposed each other). As a result, the process cartridge 15 is disposed rearward and upward of the scanning unit 16 with a slight space therebetween.

Then, when the user pulls the holding part 75 forward and upward, the end portions of the drum shaft 82 in the left-right direction are guided by the corresponding drum shaft guide parts 50, and the guide bosses 73 (see FIG. 3) are moved from the second portions 53 to first portions 52 and are guided by the first portions 52.

As a result, the process cartridge 15 is moved forward and upward in the removing direction C.

Then, as illustrated in FIG. 7, the process cartridge 15 passes through a region in the process cartridge mounting/removing space S1. Here, the region in the process cartridge mounting/removing space S1 is disposed rearward and upward of the second covering part 49. The process cartridge 15 is detached from the main casing 2 through the cartridge access opening 5.

With the above procedure, the process cartridge 15 is moved from the mounted position (see FIG. 5) to the removed position at which the process cartridge 15 is detached from the main casing 2, whereby the detachment of the process cartridge 15 from the main casing 2 is completed.

(2) Mounting Operation of Process Cartridge to Main Casing 2

To mount the process cartridge 15 to the main casing 2, a procedure reverse to the above removing operation is performed.

Specifically, as illustrated in FIG. 7, in a state where the top cover 7 is disposed at its open position, the process cartridge 15 is disposed at an inserting position such that the adjacent direction A substantially parallel to with the mounting direction D. The mounting direction D is directed from the front upper side to rear lower side, and the removing direction C and the mounting direction D are opposed to each other.

Then, the user holds the holding portion 77 of the process cartridge 15 disposed at the inserting position and inserts the process cartridge 15 into the process cartridge mounting/removing space 51 through the cartridge access opening 5 such that the both end portions of the drum shaft 82 in the left-right direction are fitted into the corresponding drum shaft guide parts 50 from the front upper side.

Then, as illustrated in FIG. 6, the user pushes the process cartridge 15 rearward and downward along the drum shaft guide part 50.

Then, the end portions of the drum shaft 82 in the left-right direction are guided by the drum shaft guide parts 50, and the guide bosses 73 are fitted into the corresponding first portions 52 of the boss guide parts 51 from the front upper side and are guided by the first portion 52. In other words, the end portions of the process cartridge 15 in the adjacent direction A are guided by the drum shaft guide parts 50 and the boss guide parts 51, respectively. Thus, the process cartridge 15 is moved in the mounting direction D (toward the rear lower side).

In this state, the process cartridge 15 passes through a region rearward and upward of the scanning unit 16 (second covering part 49) with a slight space from the scanning unit 16, and the guide bosses 73 (see FIG. 3) reach the lower end portions of the respective first portions 52 (see FIG. 6).

When the user further pushes downward the holding portion 77 of the process cartridge 15, the end portions of the drum shaft 82 in the left-right direction are guided by the drum shaft guide parts 50, and the guide bosses 73 (see FIG. 3) are moved from the first portions 52 to the second portions 53 and are guided by the second portions 53.

As a result, the process cartridge 15 is pivotally moved about the drum shaft 82 in a pivotally-moving direction E (clockwise direction in a left side view). That is, the guide part 37 guides the pivotal motion (or rotation) of the process cartridge 15. As illustrated in FIG. 5, the pivotally-moving direction E is the clockwise direction in a left side view, and the pivotally-moving direction B and the pivotally-moving direction E are opposed to each other.

Then, as illustrated in FIG. 5, the process cartridge 15 is disposed at the mounted position such that the adjacent direction A shifted from the mounting direction D to a direction that is not parallel to the direction D. The mounting direction D and the pivotally-moving direction E correspond to an example of an mounting direction.

With the above procedure, the attachment of the process cartridge 15 to the main casing 2 is completed.

5. Mounting/Removing Operation of Developer to/from Drum Cartridge Disposed at Mounted Position As indicated by a virtual line in FIG. 5, to remove the developing cartridge 19 from the drum cartridge 18 disposed at the mounted position, the user holds the developing cartridge holding part 80 to pull a front end portion of the developing cartridge 19 forward and upward.

Then, the developing cartridge 19 sequentially passes through the developing cartridge removing space S2 and the process cartridge mounting/removing space S1 and is then detached from the main casing 2 through the cartridge access opening 5.

In this state, a removing direction F of the developing cartridge 19 substantially coincides with the removing direction C of the process cartridge 15.

To attach the developing cartridge 19 to the process cartridge 15 disposed at the mounted position, a procedure reverse to the above removing operation is performed.

6. Functions and Effects (1) As illustrated in FIG. 5, the process cartridge 15 is detachably attached inside the main casing 2 through the cartridge access opening 5. That is, inside the main casing 2, the process cartridge mounting/removing space S1 for detaching the process cartridge 15 from the main casing 2 is ensured between the cartridge access opening 5 and the process cartridge 15 disposed at the mounted position.

The holding portion 77 of the holding part 75 is disposed below (at a side opposite to the cartridge access opening 5) the emission trajectory of the laser beam L in the process cartridge mounting/removing space S1 so as to be held when the attached process cartridge 15 is detached from the main casing 2.

Thus, when detaching the process cartridge 15 from the main casing 2, the user inserts his or her hand into the process cartridge mounting/removing space S1 such that the hand passes through the emission trajectory of the laser beam L from above to below (from the cartridge access opening 5 side to an opposite side thereof) and holds the holding portion 77.

That is, in the mounting/removing space S1 for detaching the process cartridge 15, a space used for holding the holding portion 77 and also used for allowing the laser beam L to pass therethrough from the scanner body 46 of the scanning unit 16 to the photosensitive drum 20 is ensured.

Thus, the space for allowing the laser beam L to pass therethrough from the scanner body 46 of the scanning unit 16 to the photosensitive drum 20 and the space for holding the holding portion 77 need not be separately ensured, thereby achieving miniaturization of the main casing 2, which in turn can lead to miniaturization of the printer 1.

(2) Further, as illustrated in FIG. 1, the process cartridge 15 includes the drum frame 65 configured to be detachably attached to the main casing 2 through the cartridge access opening 5 and the developing cartridge 19 configured to be detachably attached to the drum frame 65.

The drum frame 65 has the photosensitive drum 20 and the holding part 75. The developing cartridge 19 has the developing roller 34 configured to supply toner to the photosensitive drum 20.

Thus, if, for example, lifetime of the photosensitive drum 20 is reached, it is only necessary to replace the drum frame 65 with new one. If lifetime of the developing roller 34 is reached, it is only necessary to replace the developing cartridge 19 with new one.

As a result, running cost can be reduced as compared to a configuration in which both the photosensitive drum 20 and the developing roller 34 are provided in one cartridge.

Further, as illustrated in FIG. 3, the drum frame 65 is formed with the developing cartridge removing space S2 for detaching therefrom the attached developing cartridge 19. The drum frame 65 mounted in the main casing 2 is disposed such that the laser beam L passes the developing cartridge removing space S2, as illustrated in FIG. 1.

Thus, a space for allowing passage of the laser beam L therethrough can be ensured in the developing cartridge removing space S2. Thus, the developing cartridge removing space S2 can be effectively utilized.

Thus, the developing cartridge removing space S2 can be effectively utilized while reducing running cost.

(3) Further, as illustrated in FIG. 1, the drum frame includes: the drum accommodating part 66 for accommodating the photosensitive drum 20; and the cartridge mounting part 67 for accommodating the developing cartridge 19. The cartridge mounting part 67 is disposed adjacent to the drum accommodating part 66.

The cartridge mounting part 67 has the holding portion 77 adjacent to the developing cartridge removing space S2 so as to provide the developing cartridge removing space S2.

Thus, a space for holding the holding portion 77 can be ensured in the developing cartridge removing space S2. Thus, the developing cartridge removing space S2 can be effectively utilized.

As a result, a space for holding the holding portion 77 need not be provided separately from the developing cartridge removing space S2, thereby reducing the size of the drum frame 65, which in turn can lead to reduce the size of the main casing 2.

Further, the holding portion 77 can be reliably held in the developing cartridge removing space S2, so that the removing operation of the process cartridge 15 (or the drum frame 65) from the main casing 2 can be performed smoothly.

Thus, the main casing 2 can be further miniaturized, as well as, the removing operation of the process cartridge 15 (or the drum frame 65) from the main casing 2 can be performed smoothly.

(4) Further, as illustrated in FIG. 1, the drum accommodating part 66 is disposed rearward (downstream in the laser beam emission direction) of the scanner body 46 so as to be opposed thereto with a space therebetween.

The cartridge mounting part 67 is disposed forward (upstream side in the laser beam emission direction) of the drum accommodating part 66 and downward (at an opposite side of the cartridge access opening 5) of the emission trajectory of the laser beam L.

Thus, in the process cartridge mounting/removing space S1, a relatively large space can be ensured between the cartridge mounting part 67 and the cartridge access opening 5.

As a result, the laser beam L is allowed to reliably pass through the space between the cartridge mounting part 67 and the cartridge access opening 5, and a space for holding the holding portion 77 can be surely provided.

Thus, the photosensitive drum 20 can be reliably exposed, as well as, the removing operation of the process cartridge 15 (drum frame 65) from the main casing 2 can be smoothly performed.

(5) Further, as illustrated in FIG. 1, the cartridge mounting part 67 is inclined downward toward the front end portion 101 (the second end portion) from the rear end portion 100 (the first end portion) connected to the drum accommodating part 66 in the adjacent direction A so as to be separated away from the emission trajectory of the laser beam L. In other words, the cartridge mounting part 67 having a front end part connected to the front end portion 101 and a rear end part connected to the rear end portion 100. The rear end part of the cartridge mounting part 67 is closer to the drum accommodating part 66 than the front end part of the cartridge mounting part of the cartridge mounting part 67 to the drum accommodating part 66. The cartridge mounting part 67 mounted in the casing 2 is disposed such that the front end part thereof is farther apart from the trajectory of the laser light L than the rear end part thereof from the trajectory of the laser light L.

Thus, a larger space can be ensured between the cartridge mounting part 67 and the cartridge access opening 5.

(6) As illustrated in FIG. 1, the cartridge mounting part 67 has the bottom wall 69 and the front wall 70.

The holding part 75 is integrally provided in the front wall 70.

The main part 76 of the holding part 75 is inclined forward toward the upper side (that is, toward the emission trajectory of the laser light L) so as to be separated away from the developing cartridge 19 from the lower end portion (the base end portion) of the main part 76. The lower end portion of the main part extends continuously to the upper end portion of the front wall 70.

Thus, in the drum frame 65, the developing cartridge removing space S2 can be surely provided.

As a result, the removing operation of the developing cartridge 19 from the drum frame 65 can be smoothly performed.

Further, the holding portion 77 is provided at the upper end portion (free end portion) of the rear surface of the main part 76. That is, the holding portion 77 is provided at a portion farthest from the developing cartridge 19, allowing easy access to the holding portion 77.

Thus, the removing operation of the process cartridge 15 (or the drum frame 65) from the main casing 2 can be performed further smoothly.

Thus, the removing operation of the developing cartridge 19 from the drum frame 65 can be performed, as well as, the removing operation of the process cartridge 15 (or the drum frame 65) from the main casing 2 can be performed further smoothly.

(7) Further, as illustrated in FIG. 2, the information display part 81 displaying information concerning the developing cartridge 19 is provided on the upper surface of the developing-cartridge frame 25 of the developing cartridge 19.

The information display part 81 is exposed through the cartridge access opening 5 in a state where the top cover 7 is disposed at the open position. That is, when being projected in the removing direction C (see FIG. 5) of the process cartridge 15 on a plane defined by the cartridge access opening 5, the information display part 81 is disposed so as to overlap the cartridge access opening 5.

Thus, when the user moves the top cover to the open position, he or she can check the information display part 81 through the cartridge access opening 5.

As a result, the user can easily grasp information concerning the developing cartridge 19 without need of detaching the process cartridge 15 from the main casing 2. This can increase maintainability of the developing cartridge 19.

(8) Further, as illustrated in FIG. 5, the removing direction C in which the process cartridge 15 is removed from the main casing 2 is substantially equal to the removing direction F in which the developing cartridge 19 is removed from the drum frame 65 mounted on the main casing 2.

Thus, the developing cartridge 19 can be detached from the drum frame 65 through the process cartridge mounting/removing space S1.

As a result, when the developing cartridge 19 is replaced with new one, the drum frame 65 need not be detached from the main casing 2, but the developing cartridge 19 can be independently detached from the main casing 2.

Thus, maintainability of the developing cartridge 19 can be increased.

(9) Further, when being attached to the main casing 2, the process cartridge 15 is configured to be pivotally moved from the inserting position (FIG. 7), at which the adjacent direction A is parallel to the mounting direction D, to the mounted position (FIG. 5) at which the adjacent direction A shifted from the mounting direction D to a shifted direction that is not parallel to the mounting direction D.

An area on a project plane of the process cartridge 15 projected in the adjacent direction A is smaller than an area on a project plane projected in a direction perpendicular to the adjacent direction A since the photosensitive drum 20 and the developing cartridge 19 are adjacently disposed.

Thus, when the process cartridge 15 is attached to the main casing 2 in the adjacent direction A, the mounting operation of the process cartridge 15 to the main casing 2 can be smoothly performed even if a size of the cartridge access opening 5 is reduced.

In this regard, when being attached to the main casing 2, the process cartridge 15 is pivotally moved from the inserting position (see FIG. 7) to mounted position (see FIG. 5).

Thus, miniaturization of the main casing 2 can be achieved, as well as mounting operation of the process cartridge 15 to the main casing 2 can be smoothly performed. At the same time, in the main casing 2, a sufficient space for holding the drum folding part 75 and for allowing the laser beam L to pass between the attached process cartridge 15 and the cartridge access opening 5 can be ensured.

(10) Further, the guide part 37 for guiding the pivotal movement of the process cartridge 15 is provided in the main casing 2.

Thus, the operation of the pivotal movement of the process cartridge 15 can be performed smoothly.

(11) Further, as illustrated in FIG. 1, the holding part 75 (holding portion 77) is disposed forward of the developing cartridge 19 (at a side opposite to the photosensitive drum 20 with respect to the developing cartridge 19) in the adjacent direction A.

Further, the guide part 37 includes the drum shaft guide part 50 for guiding the rear end portion (photosensitive drum 20 side) of the process cartridge 15 and the boss guide part 51 for guiding the front end portion (holding part 75 side) of the process cartridge 15. In other words, the rear end portion of the process cartridge 15 is closer to the photosensitive drum 20 than the front end portion of the process cartridge 15 to the photosensitive drum 20. The rear end portion is guided by the drum shaft guide part 50 and the front end portion is guided by the boss guide part 51.

Thus, when the process cartridge is attached to the main casing 2, the rear end portion and front end portion thereof are guided by the drum shaft guide part 50 and the boss guide part 51, respectively.

That is, when the process cartridge 15 is attached to the main casing 2, the both end portions thereof in the adjacent direction A are guided by the drum shaft guide part 50 and the boss guide part 51, respectively.

Thus, the operation of the pivotal movement of the process cartridge 15 can be performed smoothly.

(12) Further, as illustrated in FIG. 7, the drum shaft guide part 50 and the boss guide part 51 are disposed such that an interval therebetween in the front-rear direction (emission direction) increases when the position of the interval shifts toward the rear-lower side (downstream side of the mounting direction D).

Thus, at the front upper side (upstream side in the mounting direction D), an interval between the drum shaft guide part 50 and the boss guide part 51 in the front-rear direction is relatively narrow.

As a result, at the upper stream side in the mounting direction D, the process cartridge 15 is reliably disposed at the inserting position at which the adjacent direction A is substantially parallel to the mounting direction D (directions A and D substantially coincide with each other or are opposed each other).

As being moved to the downstream side in the mounting direction D, the process cartridge 15 is pivotally moved such that an interval between the rear end portion (portion of the photosensitive drum 20 side) and front end portion (portion of the holding part 75 side) in the front-rear direction increases.

As a result, the process cartridge 15 can be reliably guided from the inserting position to the mounted position.

(13) Further, as illustrated in FIG. 7, the rear end portion of the boss guide part 51 (downstream side end portion in the mounting direction D) is disposed forward and downward of the rear end portion (downstream side end portion in the mounting direction D) of the drum shaft guide part 50.

Thus, as illustrated in FIG. 5, in a state where the process cartridge 15 is disposed at the mounted position, the front end portion (the holding part 75 side) of the process cartridge 15 is disposed down side of the rear end portion (the photosensitive drum 20 side) of the process cartridge 15.

As a result, a relatively large space can be ensured between the cartridge mounting part 67 (the holding part 75 side) of the process cartridge 15 and the cartridge access opening 5.

Thus, the laser beam L is allowed to reliably pass through the space between the cartridge mounting part 67 of the process cartridge 15 and the cartridge access opening 5, and a space for holding the holding portion 77 can reliably be ensured.

(14) As illustrated in FIGS. 1 and 5, the main casing 2 has the top cover 7 configured to be movable between the open position for exposing the cartridge access opening 5 and the closed position for covering the cartridge access opening 5.

Further, as illustrated in FIG. 1, the discharge tray 41 is provided at a front part of the top cover 7. The sheet P on which a toner image is formed is discharged to the discharge tray 41.

Thus, the user can access the sheet P discharged onto the discharge tray 41.

Further, in a state where the top cover 7 is disposed at the closed position, the discharge tray 41 is disposed near (rearward and upward of) the scanner body 46 so as to face inside the main casing 2 through the cartridge access opening 5. Thus, the discharge tray 41 can be effectively disposed.

As a result, an increase in a size of the main casing can be suppressed while the discharge tray 41 is provided.

(15) Further, the cartridge access opening 5 is formed above the emission trajectory of the laser beam L in the up-down direction (vertical direction).

Further, the scanner body 46 of the scanning unit 16 is disposed so as to be opposed to and spaced apart from the photosensitive drum 20 in the front-rear direction (in a horizontal direction).

Thus, the process cartridge 15 and the scanning unit 16 can be disposed further effectively. This can lead to further miniaturization of the printer 1.

7. Modification

In the above embodiment, as illustrated in FIG. 5, when the drum cartridge 18 is disposed at the mounted position, the developing cartridge 19 is independently removed from the main casing 2 (specifically, the mounted drum cartridge 18). However, the present invention is not limited to this. For example, the developing cartridge 19 may be configured to be undetachable from the drum cartridge 18 when the drum cartridge 18 is disposed at the mounted position.

In this case, the developing cartridge 19 is detached from the main casing 2 integrally with the drum cartridge 18 and is then detached from the drum cartridge 18.

Also with this configuration, the same effects as those in the above embodiment can be obtained.

The above described printer 1 is an embodiment of the image forming device of the present invention. The present invention is not limited to the printer 1 described in the embodiments described above.

The image forming apparatus of the present invention may be constituted not only to the above-described monochromic printer but also to a color printer.

Examples of the color printer include: a direct tandem color printer provided with a plurality of photosensitive bodies and a recording medium conveying member; and an intermediate-transfer-type tandem color printer provided with a plurality of photosensitive bodies, an intermediate transfer body, and a transfer member.

An cartridge that is to be mounted to the image forming device of the present invention includes the process cartridge 15 and the drum cartridge 18 described above.

In addition to the separable process cartridge 15 that allows the drum cartridge 18 and the developing cartridge 19 to be detached from each other as described above, the process cartridge 15 may be an integrated unit in which the drum cartridge 18 and the developing cartridge 19 are integrally provided.

The developing cartridge 19 may also be configured such that a toner cartridge for accommodating toner is detachably mountable on a frame provided with the developing roller 34.

In place of the photosensitive drum 20, a photosensitive belt or other photosensitive body may be employed.

In place of the developing roller 34, a developing sleeve, a developing belt, a brush roller, or other developer bearing member may be used.

Further, in place of the supply roller 33, a supply sleeve, a supply belt, a brush roller, or other supply member may be used.

Further, in place of the agitator 29, an auger screw, a conveying belt, or other conveying member may be used.

Further, in place of the transfer roller 21, a contact-type transfer member, such as a transfer belt, a transfer brush, a transfer blade, and a film-like transfer device; or a non-contact-type transfer member such as a corotron-type transfer member may be used.

Further, in place of the scorotron charger 22, a non-contact type charger, such as a corotron-type charger and a charger provided with a sawtooth discharge member; or a contact-type charger such as a charging roller may be used.

Further, the information display part 81 described above displays the information concerning the developing cartridge 19. However, the present invention is not limited to this, but the information display part 81 may display an instruction such as an operation manual concerning the mounting/removing operation of the process cartridge 15 with respect to the main casing 2 or a company name.

Further, an image forming device of the present invention may be an multifunction peripheral having an image reading unit as well as an image forming unit.

Also with these configurations, the same effects as those in the above embodiment can be obtained.

Any two or more of the above described embodiments and modifications may be combined appropriately.

While the invention has been described in detail with reference to the embodiment thereof, it would be apparent to those skilled in the art that various changes and modifications may be made therein without departing from the scope of the invention.

What is claimed is:

1. An image forming apparatus comprising:

a housing having a cartridge access opening formed in an upper end portion of the housing and a paper-introducing opening formed in a front end portion of the housing;

a top cover provided on the upper end portion of the housing, the top cover being movable between a closed position for covering the cartridge access opening and an open position for exposing the cartridge access opening;

a sheet-feeding cover provided on the front end portion of the housing, the sheet-feeding cover being movable between a first position in which the sheet-feeding cover covers the paper-introducing opening and a second position in which the paper-introducing opening is exposed;

a process cartridge detachably mountable in the housing through the cartridge access opening, the process cartridge comprising:

a drum cartridge including a photosensitive drum and a drum holding part configured to be held by a user so as to remove the process cartridge from the housing; and a developing cartridge detachably mountable in the drum cartridge, the developing cartridge including a developing roller and a developing holding part configured to be held by a user so as to remove the developing cartridge from the drum cartridge; and a scanning unit configured to emit a laser light to the photosensitive drum in an emitting direction so as to expose the photosensitive drum to the laser light, the scanning unit being disposed between the process cartridge and the sheet-feeding cover when the process cartridge is mounted in the housing, the scanning unit being disposed so as not to overlap with the process cartridge when the process cartridge is mounted in the housing;

wherein the drum holding part and the developing holding part located below a trajectory of the laser light when the scanning unit emits the laser light in a state where the process cartridge is mounted in the housing, and wherein a distance between the drum holding part and the top cover is smaller than a distance between a developing holding part and the top cover when the scanning unit emits the laser light in a state where the process cartridge is mounted in the housing.

2. The image forming apparatus according to claim 1, wherein the drum cartridge includes:

a drum accommodating part accommodating the photosensitive drum; and a cartridge mounting part on which the developing cartridge is configured to be detachably mounted, the drum holding part being provided in the cartridge mounting part.

3. The image forming apparatus according to claim 2, wherein the cartridge mounting part of the drum cartridge is located between the drum accommodating part of the drum cartridge and the scanning unit when the process cartridge is mounted in the housing.

4. The image forming apparatus according to claim 2, wherein the cartridge mounting part of the drum cartridge includes:

a pair of cartridge-mounting-part side walls;

a bottom wall connecting lower edges of the pair of cartridge-mounting-part side walls; and a front wall connecting front edges of the pair of cartridge-mounting-part side walls, the front wall having a base end part and another end part, the front wall extending such that the another end part is farther apart from the developing cartridge than the base end part from the developing cartridge, and wherein the drum holding part is disposed on the another end part of the front wall.

5. The image forming apparatus according to claim 4, wherein the photosensitive drum has a drum shaft, wherein the drum cartridge has a guide boss provided on outer surfaces of the pair of cartridge-mounting-part side walls, and wherein the housing includes a first guide part for guiding the drum shaft and a second guide part for guiding the guide boss.

6. The image forming apparatus according to claim 5, wherein the process cartridge is configured to be mounted in the housing in a mounting direction, and wherein an interval between the first guide part and the second guide part increases as a position of the interval shifts in a mounting direction.

7. The image forming apparatus according to claim 5, wherein a lower end of the second guide part is located below a lower end of the first guide part.

8. The image forming apparatus according to claim 7, wherein a distance between the lower end of the first guide part and the lower end of the second guide part is larger than a distance between an upper end of the first guide part and an upper end of the second guide part.

9. The image forming apparatus according to claim 7, wherein the top cover includes a discharge tray on which a recording sheet is discharged after an image is formed on the recording sheet, the discharge tray being located right above the scanning unit when the top cover is located at the closed position.

10. The image forming apparatus according to claim 7, wherein the developing holding part has a first developing holding part and a second developing holding part.

11. The image forming apparatus according to claim 1, wherein the developing cartridge includes an information display part on which information concerning the developer cartridge is displayed, and wherein the information display part is provided at an upper surface of the developing cartridge.

12. The image forming apparatus according to claim 1, wherein the housing includes a guide part configured to guide the process cartridge.

13. The image forming apparatus according to claim 1, wherein the developing holding part has a flat plate shape extending from a front edge of the developing cartridge.

14. The image forming apparatus according to claim 1, wherein the drum holding part has:

a main body having a flat shape; and a holding portion having a triangular shape in a side view, the holding portion protruding from main body.

* * * * *